US009413098B2

(12) United States Patent
Chien et al.

(10) Patent No.: US 9,413,098 B2
(45) Date of Patent: Aug. 9, 2016

(54) WATERPROOF ELECTRONIC RECEPTACLE CONNECTOR

(71) Applicant: ADVANCED-CONNECTEK INC., New Taipei (TW)

(72) Inventors: Min-Lung Chien, New Taipei (TW); Ming-Yung Chang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 19 days.

(21) Appl. No.: 14/627,808

(22) Filed: Feb. 20, 2015

(65) Prior Publication Data

US 2015/0244101 A1 Aug. 27, 2015

(30) Foreign Application Priority Data

Feb. 26, 2014 (TW) ..... 103203362 U

(51) Int. Cl.
*H01R 13/40* (2006.01)
*H01R 13/52* (2006.01)
*H01R 12/72* (2011.01)

(52) U.S. Cl.
CPC ..... *H01R 13/5202* (2013.01); *H01R 13/521* (2013.01); *H01R 12/724* (2013.01)

(58) Field of Classification Search
CPC ..... H01R 13/4223; H01R 13/5216
USPC ..... 439/595, 680, 589, 598, 587, 594, 936, 439/274
See application file for complete search history.

(56) References Cited

U.S. PATENT DOCUMENTS

| | | | | |
|---|---|---|---|---|
| 8,388,380 | B1 * | 3/2013 | Van der Steen | H01R 13/5202 439/607.36 |
| 8,597,047 | B2 * | 12/2013 | Soubh | H01R 13/6477 439/485 |
| 9,093,797 | B2 * | 7/2015 | Zhao | H01R 12/707 |
| 2010/0062642 | A1 * | 3/2010 | Zhang | H01R 13/508 439/607.41 |
| 2013/0065442 | A1 * | 3/2013 | Nagata | H01R 13/5202 439/607.58 |
| 2015/0207281 | A1 * | 7/2015 | Chien | H01R 24/62 439/676 |
| 2015/0244101 | A1 * | 8/2015 | Chien | H01R 13/5202 439/271 |
| 2015/0325955 | A1 * | 11/2015 | Chien | H01R 13/6581 439/607.25 |

* cited by examiner

*Primary Examiner* — Phuongchi T Nguyen
(74) *Attorney, Agent, or Firm* — Muncy, Geissler, Olds & Lowe, P.C.

(57) ABSTRACT

A waterproof electronic receptacle connector includes a plastic-core housing, an insulation housing, terminals, a waterproof ring gasket and a sealing material. The plastic-core housing includes a through hole. The insulation housing is configured in the through hole and includes a base and a tongue plate. The base includes an inner side plane facing toward the through hole and an outer side plane facing toward an outside of the through hole. The tongue plate is extended from the inner side plane. The terminals are passing through the base. Each terminal includes a contacting end extended from the tongue plate and a welding end connected to the contacting end and extruded from the outer side plane. The waterproof ring gasket is abutted between the base and an inner wall of the through hole. The sealing material is formed on the outer side plane to fill gaps between the terminal and the base.

13 Claims, 7 Drawing Sheets

100

100

WATERPROOF ELECTRONIC RECEPTACLE CONNECTOR

CROSS-REFERENCES TO RELATED APPLICATIONS

This non-provisional application claims priority under 35 U.S.C. §119(a) on Patent Application No. 103203362 filed in Taiwan, R.O.C. on Feb. 26, 2014, the entire contents of which are hereby incorporated by reference.

FIELD OF THE INVENTION

The disclosure relates to an electronic receptacle connector, and particularly to a waterproof electronic receptacle connector.

BACKGROUND

USB, universal serial bus, is a common electronic connector interface applied to electronic devices. In order to be smaller and portable, a micro USB electrical connector is developed, which is usually equipped with a connection hole and a corresponding transmission line for various portable electronic apparatuses such as a smart mobile communications device and a digital camera.

Conventionally, a Micro USB electronic connector includes an insulation housing and a tongue plate structure formed at the front portion of the insulation housing, a plurality of terminals is configured on the insulation housing and the tongue plate structure, and a hollow shell encloses the insulation housing and the tongue plate structure. In order to prevent moisture entering from one side of the hollow shell into another side of the hollow shell, a sealing material, such as a waterproof adhesive bulk with large area, is applied to cover the rear portion of the insulation housing, so that the sealing material is filled into the gaps between the hollow shell, the insulation housing and the plurality of terminals, to ensure the electronic connector is waterproof.

However, the cost of the conventional sealing material is high; additionally, the sealing material is commonly available in a liquid form, for forming the waterproof adhesive bulk in larger areas, so the sealing material requires a drying procedure for a longer time, resulting into additional costs for the manufacturer. Consequently, there is an urgent need for the manufacturers of the electronic connector to solve the drawbacks raised by the conventional.

SUMMARY OF THE INVENTION

In view of this, the disclosure provides a waterproof electronic receptacle connector in which the amount of the sealing material is reduced and moisture is prevented from entering the interior of the waterproof electronic receptacle connector, to solve the problems met by the conventional.

The disclosure provide a waterproof electronic receptacle connector including a plastic-core housing, an insulation housing, a plurality of terminals, a waterproof ring gasket and a sealing material (for example, waterproof adhesive bulk). The plastic-core housing includes a through hole. The insulation housing is configured in the through hole, and includes a base and a tongue plate. The base includes an inner side plane and an outer side plane. The inner side plane faces toward the through hole, and the outer side plane faces toward an outside of the through hole. The tongue plate is extended from the inner side plane. The plurality of terminals is passing through the base. Each of the plurality of terminals includes a contacting end and a welding end connected to the contacting end. The contacting end is extended from the tongue plate, and the welding end is extruded from the outer side plane. The waterproof ring gasket is abutted between the base and an inner wall of the through hole. The sealing material is formed on parts of the outer side plane to fill gaps between the plurality of terminals and the base. The area of the sealing material formed on the outer side plane is smaller than the area of the outer side plane.

The disclosure also provides a waterproof electronic receptacle connector including a plastic-core housing, an insulation housing, a plurality of terminal grooves, a plurality of terminals, a waterproof ring gasket and a sealing material (for example, waterproof adhesive bulk). The plastic-core housing includes a through hole. The insulation housing is configured in the through hole and includes a base and a tongue plate. The base includes an inner side plane and an outer side plane. The inner side plane faces toward the through hole, and the outer side plane faces toward an outside of the through hole. The tongue plate is extended from the inner side plane. The plurality of terminal grooves passes through the base to communicate with the inner side plane and the outer side plane. The plurality of terminals is configured in the plurality of terminal grooves, respectively. Each of the plurality terminals includes a contacting end and a welding end. The contacting end is extended from the tongue plate, and the welding end is extruded from the outer side plane. The waterproof ring gasket is abutted against the base and an inner wall of the through hole. The sealing material is formed on parts of the outer side plane to fill gaps between the welding ends and the plurality of terminal grooves. The area of the sealing material formed on the outer side plane is smaller than the area of the outer side plane.

The disclosure further provides a waterproof electronic receptacle connector including a plastic-core housing, an insulation housing, a plurality of terminals, a waterproof ring gasket and a sealing material (for example, waterproof adhesive bulk). The plastic-core housing includes a through hole. The insulation housing is configured in the through hole and includes a base, a tongue plate, a plurality of protruding blocks and a gluing slot. The base includes an inner side plane and an outer side plane. The inner side plane faces toward the through hole, and the outer side plane faces toward an outside of the through hole. The tongue plate is extended from the inner side plane. The plurality of protruding blocks is configured on the base. The gluing slot is configured on the base and includes a plurality of extended recessions respectively corresponding to two sides of the plurality of protruding blocks. The plurality of terminals passes through the base. One faces of the plurality of terminals respectively abutted against the plurality of protruding blocks. Each of the plurality of terminals includes a contacting end and a welding end connected to the contacting end. The contacting end is extended from the tongue plate, and the welding end is extruded from the outer side plane. The waterproof ring gasket is abutted against the base and an inner wall of the through hole. The sealing material is formed in the gluing slot and the plurality of extended recessions to enclose the plurality of terminals.

The disclosure further provides a waterproof electronic receptacle connector including a plastic-core housing, an insulation housing, a plurality of terminal grooves, a plurality of terminals, a waterproof ring gasket and a sealing material (for example, waterproof adhesive bulk). The plastic-core housing includes a through hole. The insulation housing is configured in the through hole and includes a base, a tongue plate, a plurality of protruding blocks and a gluing slot. The base includes an inner side plane and an outer side plane. The inner side plane faces toward the through hole, and the outer side plane faces toward an outside of the through hole. The tongue plate is extended from the inner side plane. The plurality of protruding blocks is configured on the base. The gluing slot is configured on the base and includes a plurality of extended recessions respectively corresponds to two sides of the plurality of protruding blocks. The plurality of terminal grooves passes through the base to communicate with the inner side plane and the outer side plane. One faces of the plurality of terminals respectively abutted against the plurality of protruding blocks. Each of the plurality of terminals includes a contacting end and a welding end connected to the contacting end. The contacting end is extended form the tongue plate, and the welding end is extruded from the outer side plane. The waterproof ring gasket is abutted against the base and an inner wall of the through hole. The sealing material is formed in the gluing slot and the plurality of extended recessions to enclose the plurality of terminals.

As above, in this disclosure the waterproof ring gasket is abutted against the base and the inner wall of through hole so as to prevent the moisture from entering into the interior of the electronic device from the outside of the base and the gaps between the inner wall of the through hole, and the sealing material, such as the waterproof adhesive bulk, is formed on the outer side plane to fill in the gaps between the welding ends and the plurality of terminals. Additionally, even if the area of the sealing material formed on the outer side plane is smaller than the area of the outer side plane, the moisture is prevented from entering into the interior of the electronic device through the through hole. A relative less amount of sealing material is applied to form on the outer side plane as compared to conventional to provide the waterproof function; additionally, the drying time for solidifying the sealing material is reduced. Alternatively, instead of forming on the outer side plane, the sealing material is applied in the gluing slot of the base to fill the gaps between the plurality of terminals and the base, thereby preventing the moisture from entering into the interior of the electronic device through the through hole.

The detailed features and advantages of the disclosure are described below in great detail through the following embodiments, the content of the detailed description is sufficient for those skilled in the art to understand the technical content of the disclosure and to implement the disclosure there accordingly. Based on the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
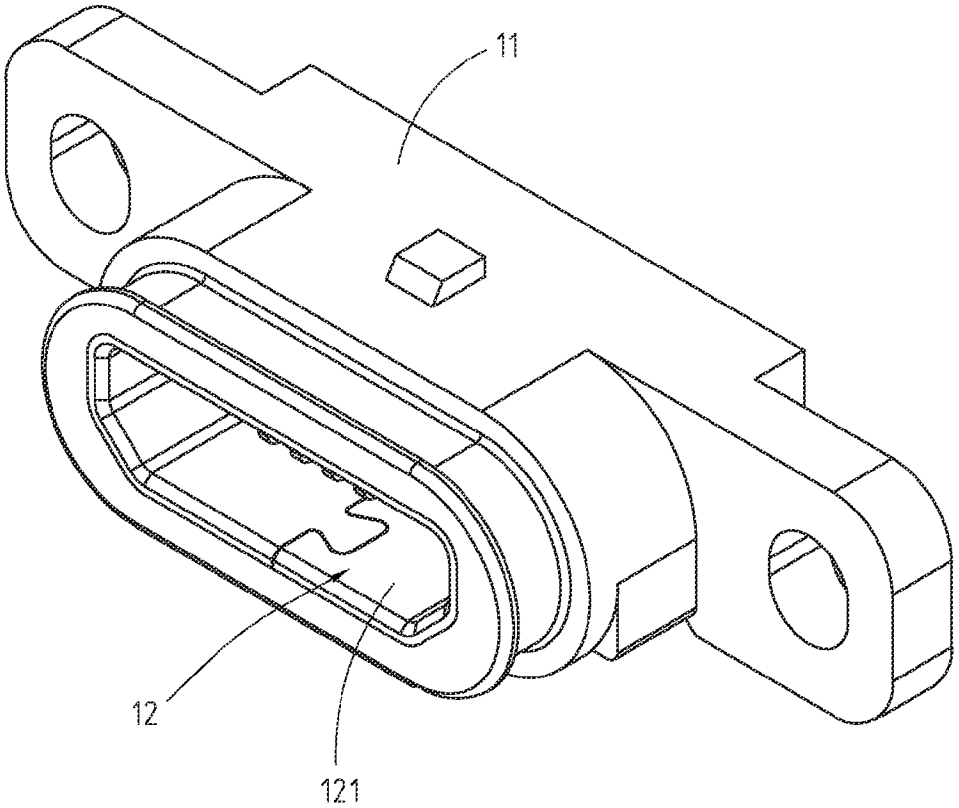
FIG. 1 is a perspective view of a waterproof electronic receptacle connector of a first embodiment of the disclosure.
Figure 2:
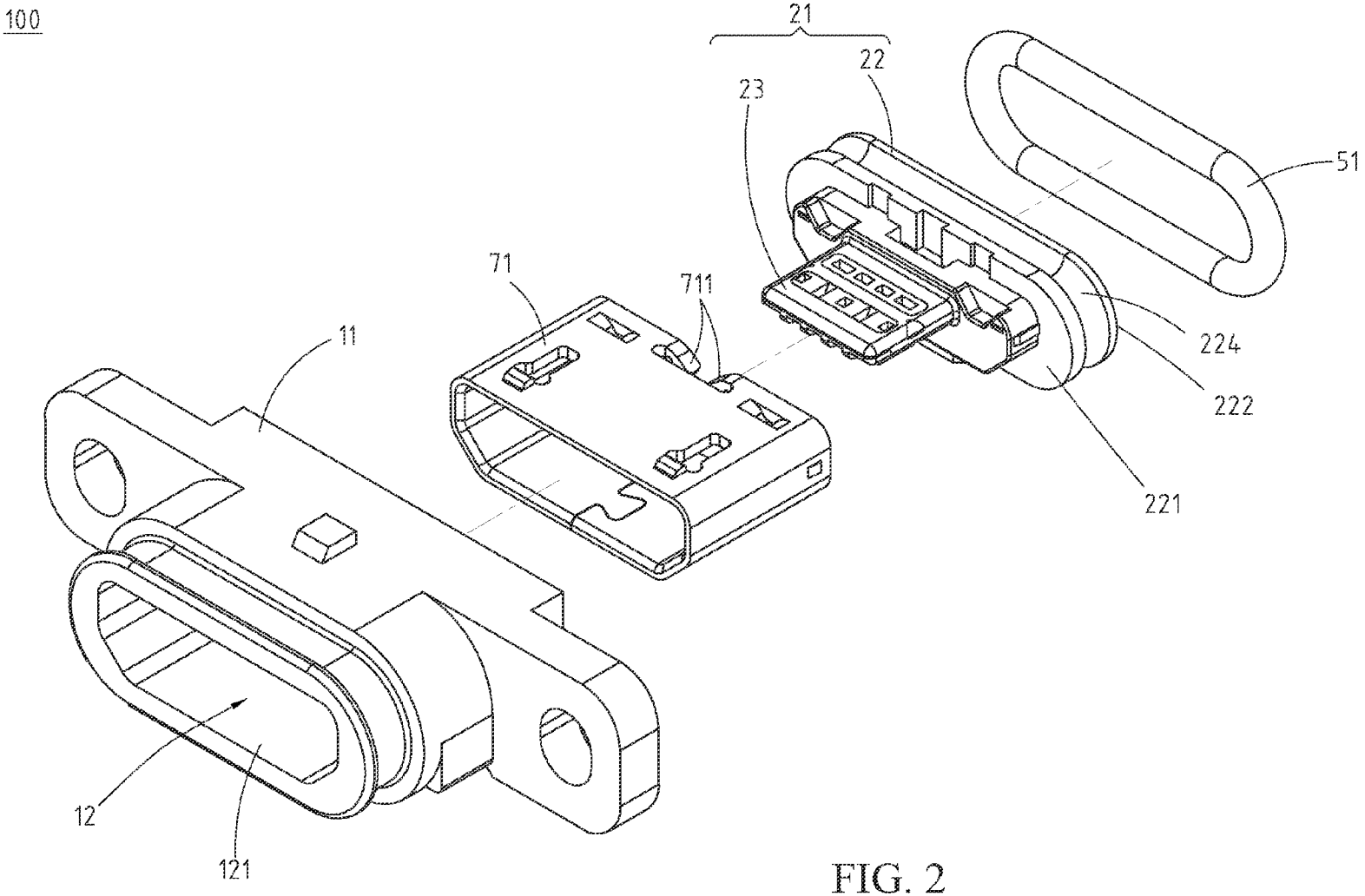
FIG. 2 is an exploded view of the waterproof electronic receptacle connector of the first embodiment of the disclosure.

Please refer to FIG. 1, FIG. 2, FIG. 3, and FIG. 4A, which illustrate a waterproof electronic receptacle connector 100 of a first embodiment of the disclosure and are respectively a perspective view, an exploded view, another exploded view and a lateral cross sectional view of the waterproof electronic receptacle connector 100. The waterproof electronic receptacle connector 100 is a Micro USB or a Mini USB electronic connector, but embodiments are not limited thereto.

The waterproof electronic receptacle connector 100 is applicable for mobile telecommunication devices, notebooks, digital cameras or other electronic devices. In this embodiment, the waterproof electronic receptacle connector 100 includes a plastic-core housing 11, an insulation housing 21, a plurality of terminal grooves 25, a plurality of terminals 41, a waterproof ring gasket 51, and a sealing material 61 (such as a waterproof adhesive bulk).

The plastic-core housing 11 is a plastic hollowed housing. A through hole 12 is formed inside of the plastic-core housing 11. The through hole 12 includes a front inserting hole 121 and a rear inserting hole 122. The diameter of the front inserting hole 121 is smaller than that of the rear inserting hole 122, or a cross sectional area of the front inserting hole 121 is smaller than that of the rear inserting hole 122. Additionally, the plastic-core housing 11 further includes an abutting plane 14 configured on an inner wall of the through hole 12. Here, the abutting plane 14 is formed by the different height between the front inserting hole 121 and the rear inserting hole 122 with different diameters, or is formed by the cross sectional area differences between the front inserting hole 121 and the rear inserting hole 122 with different cross sectional areas.

The insulation housing 21 is configured in the through hole 12, wherein the insulation housing 21 includes a base 22 and a tongue plate 23. The tongue plate 23 is extended from one side of the base 22. The tongue plate 23 and the base 22 are formed integrally as a whole. The front portion of the base 22 includes an inner side plane 221, and the rear portion of the base 22 includes an outer side plane 222. The inner side plane 221 is faced toward the through hole 12, and the outer side plane 222 is faced toward an outside of the through hole 12. The tongue plate 23 is a plate with long and flat outline and extended outwardly from the inner side plane 221. Additionally, the base 22 further includes an indentation 224 configured on an outer periphery between the inner side plane 221 and the outer side plane 222. In this embodiment, the plurality of terminal grooves 25 is passing through the base 22 to communicate with the inner side plane 221 and the outer side plane 222.

The plurality of terminals 41 is configured in the plurality of terminal grooves 25 respectively. Each of the plurality of terminals 41 includes a contacting end 411 and a welding end 412 respectively formed at two ends thereof, wherein the contacting end 411 is connected to the welding end 412. The contacting ends 411 are extended from one face of the tongue plate 23, and the welding ends 412 are extruded from the outer side plane 222.

The waterproof ring gasket 51 is a plastic O-ring and is abutted between the base 22 and an inner wall of the through hole 12. In this embodiment, the waterproof ring gasket 51 is fitted in the indentation 224 of the base 22 with parts thereof received in the indentation 224 and rest parts thereof exposed out of the indentation 224.

The sealing material 61 is formed on the outer side plane 222 and fills gaps between the plurality of terminal grooves 25 and the welding ends 412.

When the sealing material 61 is going to be formed on the outer side plane 222, the outer side plane 222 is placed horizontally, and the liquid sealing material 61 (when the sealing material 61 is not solidified yet, the sealing material 61 is in liquid form) is applied in the gaps between the welding ends 412 and the plurality of terminal grooves 25. After the liquid sealing material underwent a drying process, the sealing material 61 is formed on the outer side plane 222 with the shape thereof being confined. The area of the sealing material 61 with confined shape formed on the outer side plane 222 is smaller than the area of the outer side plane 222. Thereby, when the outer side plane 222 is placed vertically along with the sealing material 61 having confined shape, the sealing material 61 does not move freely to expose the gaps between the welding ends 412 and the plurality of terminal grooves 25. Additionally, because of the sealing material 61 filled in the gaps between the welding ends 412 and the plurality of terminal grooves 25, outer moisture cannot enter into the interior of the electronic device to which the waterproof electronic receptacle connector 100 is connected with, through the gaps between the welding ends 412 and the plurality of terminal grooves 25. That is, the moisture can now only enter into the interior of the electronic device through the path between the front inserting hole 121 and the rear inserting hole 122.

Figure 3:
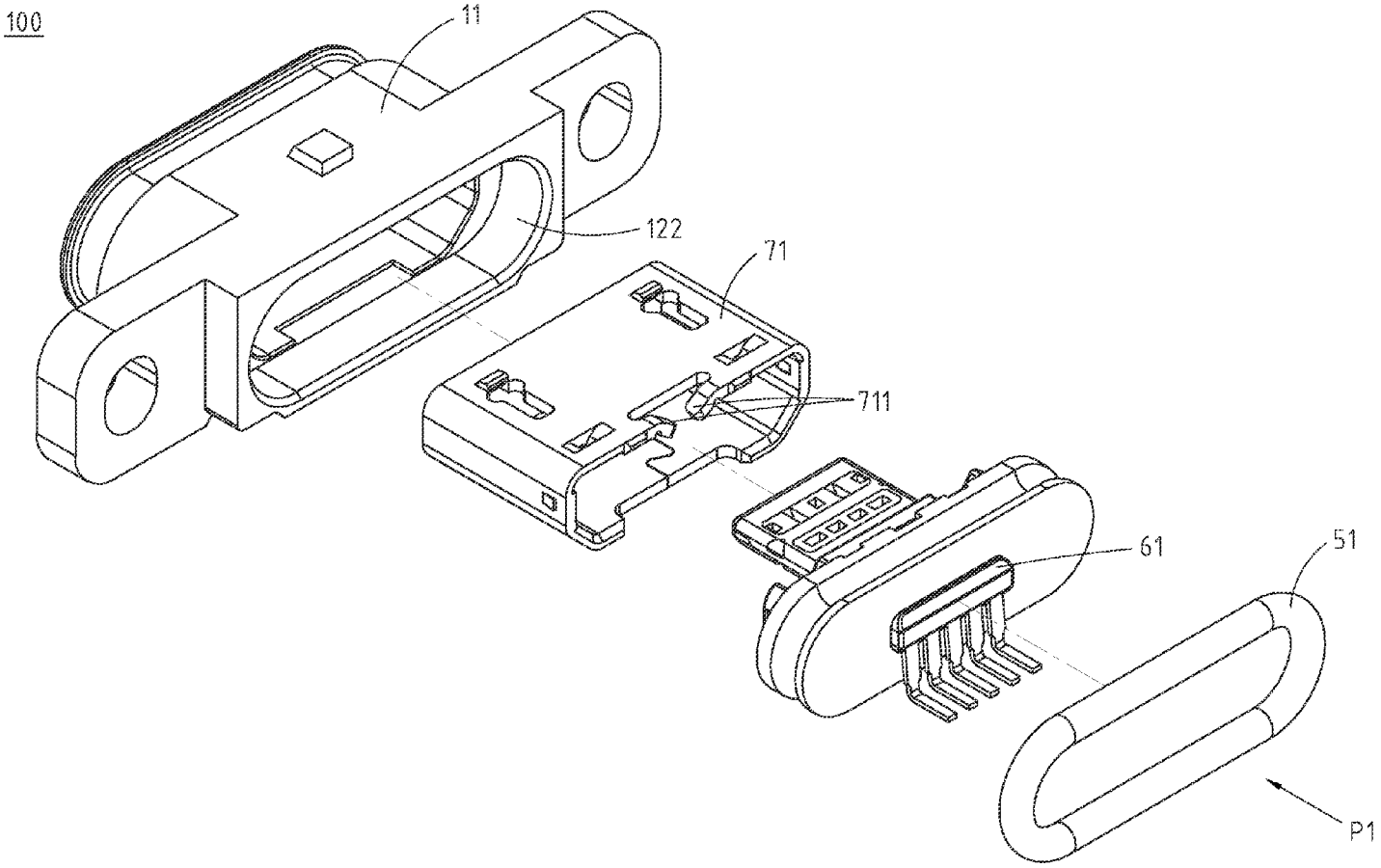
FIG. 3 is another exploded view of the waterproof electronic receptacle connector of the first embodiment of the disclosure.
Figure 4A:
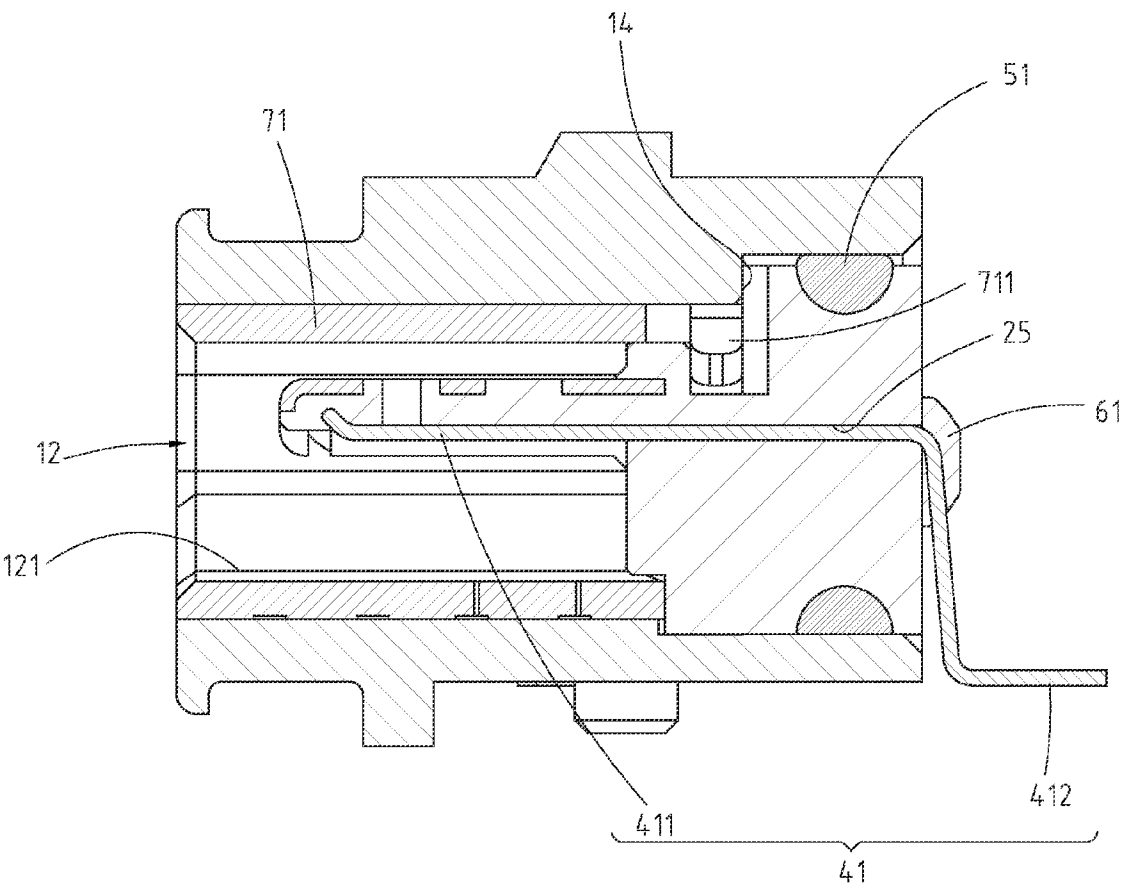
FIG. 4A is a lateral cross sectional view of the waterproof electronic receptacle connector of the first embodiment of the disclosure.

When the waterproof ring gasket 51 is fitted on the base 22, parts of the waterproof ring gasket 51 are exposed out of the base 22. Thereby, the insulation housing 21 is inserted into the front inserting hole 121 from the rear inserting hole 122 with an installing direction P1, as shown in FIG. 3 and FIG. 4A, so that the abutting plane 14 of the plastic-core housing 11 is abutted against parts of the inner side plane 221, and the waterproof ring gasket 51 is abutted between the base 22 and the inner wall of the through hole 12, thereby ensuring the waterproof ring gasket 51 which is securely attached with the base 22 prevents the moisture from entering into the interior of the electronic device through the path between the front inserting hole 121 and the rear inserting hole 122.

Figure 4B:
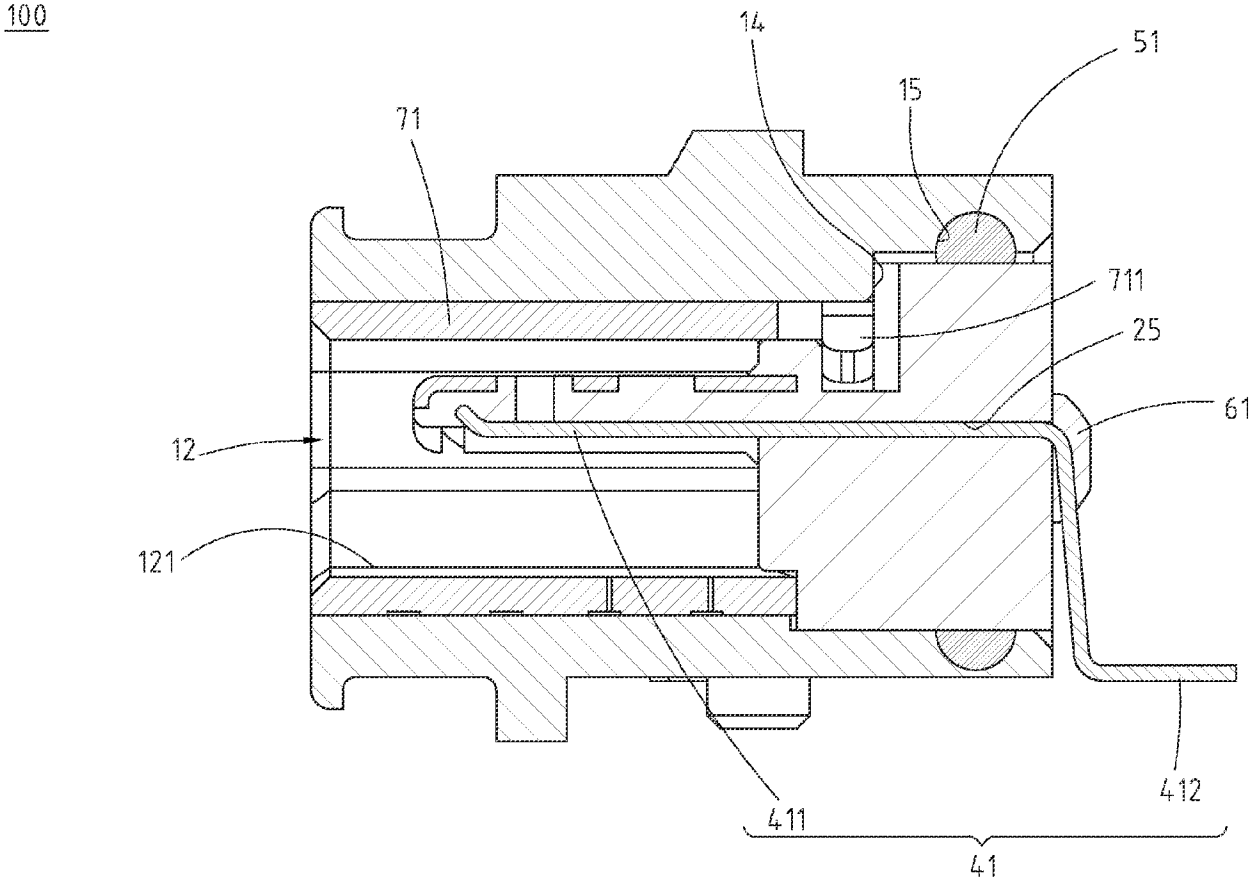
FIG. 4B is another lateral cross sectional view of the waterproof electronic receptacle connector of the first embodiment of the disclosure.

In this embodiment, the base 22 includes the indentation 224 for sleeving with the waterproof ring gasket 51, but embodiments are not limited thereto; in some implementation aspects, the plastic-core housing 11 further includes a groove 15 configured on the inner wall of the through hole 12 to fit with the waterproof ring gasket 51, as shown in FIG. 4B. After the base 22 is configured in the through hole 12, the waterproof ring gasket 51 is securely attached with the base 22 and the inner wall of the through hole 12. Additionally, the waterproof ring gasket 51 is assembled in the groove 15 of the plastic-core housing 11, or is formed on the inner wall of the through hole 12 upon injection-molding the plastic-core housing 11.

The waterproof electronic receptacle connector 100 further includes a casing 71. The casing 71 encloses the tongue plate 23 of the insulation housing 21 and is configured in the through hole 12. The casing 71 reduces the electromagnetic interferences when the plurality of terminals 41 is transmitting signals. Furthermore, the casing 71 includes a plurality of buckles 711 bent therefrom and fastened with the base 22 of the insulation housing 21.

In the previous embodiment, the plurality of terminal grooves 25 is provided and the plurality of terminals 41 is configured in the plurality of terminal grooves 25 and passing through the base 22, but embodiments are not limited thereto; in some implementation aspects, the insulation housing 21 and the plurality of terminals 41 are formed integrally as a whole. The method, such as insert molding, over molding, other molding techniques or the combinations thereof, can be used for forming the components integrally, which is not used to limit the present invention. In this case, the plurality of terminal grooves 25 is omitted, and the plurality of terminals 41 is directly passing through the base 22. However, since the thermal expansion coefficients between the terminal 41 made of metal and the insulation housing 21 made of plastic are different, when the waterproof electronic receptacle connector 100 is heated during manufacturing processes, for example, during the tin furnace procedure, gaps are generated between the plurality of terminals 41 and the insulation housing 21, thereby providing insufficient waterproof performance. Therefore, the sealing material 61 mentioned above, such as the waterproof adhesive bulk, is also applied to form on the outer side plane 222 of the waterproof electronic receptacle connector 100 with the insulation housing 21 being integrally formed with the plurality of terminals 41, wherein the sealing material 61 is filled in the gaps between the welding ends 412 and the base 22, and the area of the sealing material 61 formed on the outer side plane 222 is smaller than the area of the outer side plane 222.

Figure 5:
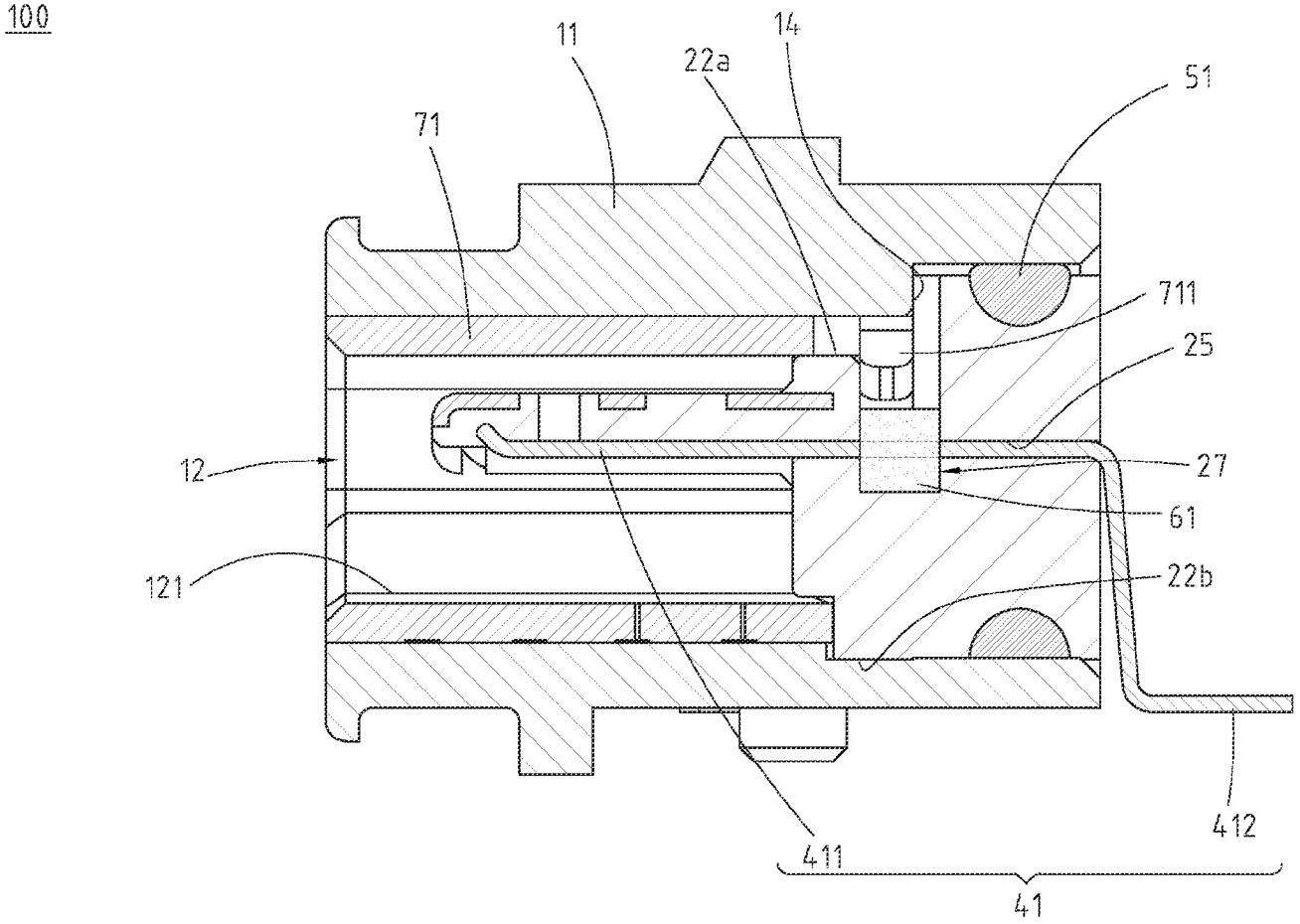
FIG. 5 is a lateral cross sectional view of a waterproof electronic receptacle connector of a second embodiment of the disclosure.
Figure 6:
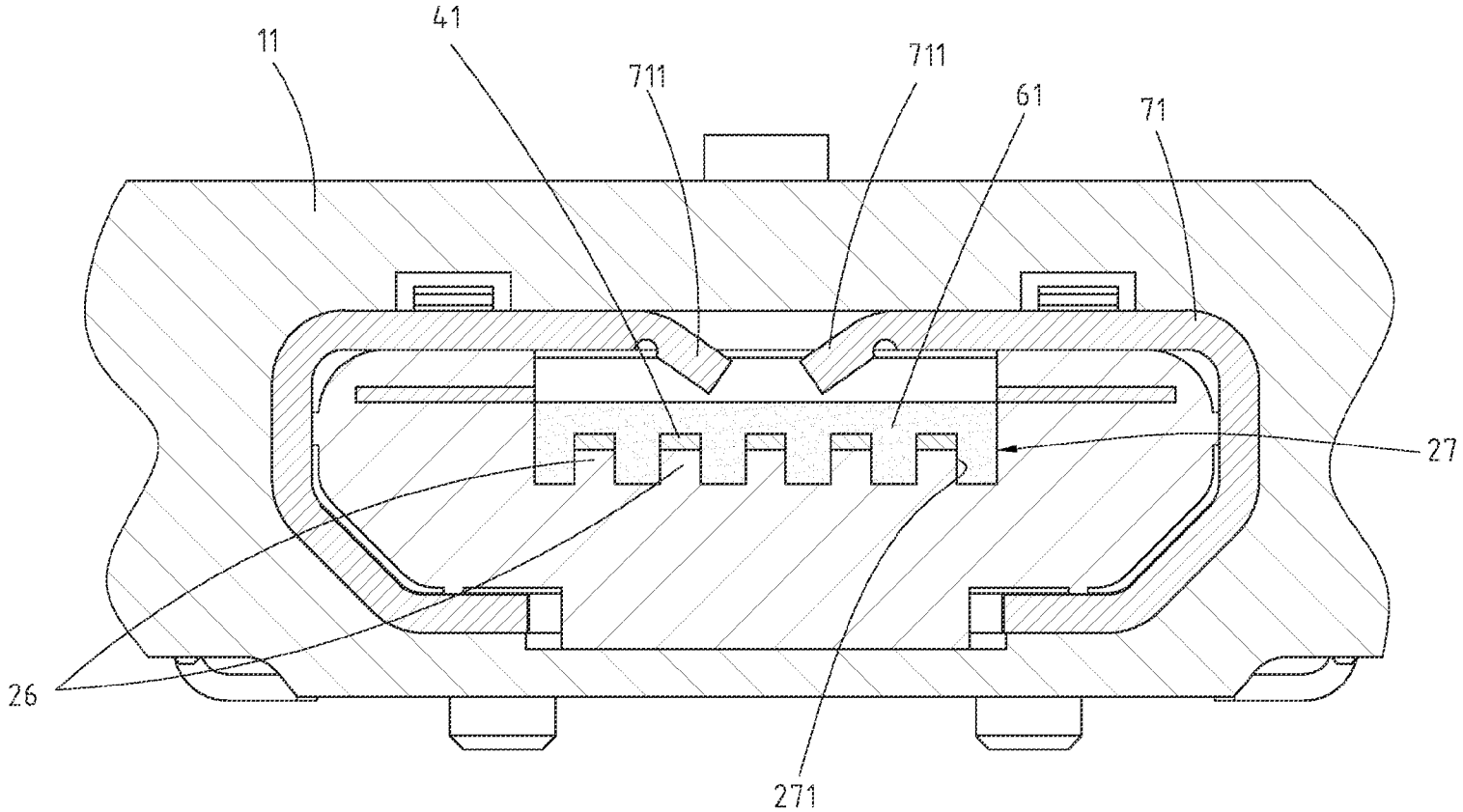
FIG. 6 is a front cross sectional view of the waterproof electronic receptacle connector of the second embodiment of the disclosure.

Please refer to FIG. 5 and FIG. 6, which illustrate a waterproof electronic receptacle connector 100 of a second embodiment. FIG. 5 is a lateral cross sectional view of the waterproof electronic receptacle connector 100 of the second embodiment, and FIG. 6 is a front cross sectional view of the waterproof electronic receptacle connector 100 of the second embodiment. The structure of the second embodiment is approximately the same as that of the first embodiment, except that in the second embodiment, the sealing material 61 is formed on the base 22 to fill gaps between the plurality of terminals 41 (but not at positions of the welding ends 412) and the plurality of terminal grooves 25. Here, the insulation housing 21 further includes a plurality of protruding blocks 26 and a gluing slot 27. The plurality of protruding blocks 26 is configured on the base 22. One faces of the plurality of terminals 41 are respectively abutted against the plurality of protruding blocks 26. The gluing slot 27 is configured on the base 22. The gluing slot 27 is inwardly formed on a top plane 22*a* of the base 22 after the base 22 is injection-molded, as shown in FIG. 5, but embodiments are not limited thereto; in some implementation aspects, the gluing slot 27 is inwardly formed on a bottom plane 22*b* of the base 22 after the base 22 is injection-molded.

The gluing slot 27 includes a plurality of extended recessions 271 configured on a bottom wall thereof. The plurality of extended recessions 271 is extended toward the bottom plane 22*b* of the base 22. Distance between bottom walls of the plurality of extended recessions 271 and the bottom plane 22*b* of the base 22 is smaller than distance between the plurality of terminals 41 and the bottom plane 22*b* of the base 22. Furthermore, the plurality of extended recessions 271 corresponds to two sides of the plurality of protruding blocks 26, respectively. Thereby, after the liquid sealing material 61 was applied in the gluing slot 27 and underwent the drying process, the sealing material 61 which is solidified and formed in the gluing slot 27 and the plurality of extended recessions 271 to enclose the plurality of terminals 41. That is, the one faces of the plurality of terminals 41 are respectively abutted against the plurality of protruding blocks 26, and the other three faces of the plurality of terminals 41 are enclosed by the sealing material 61. Consequently, the gaps between the plurality of terminals 41 and the plurality of terminal grooves 25 in the gluing slot 27 are filled with the sealing material 61.

Similar to the previous embodiments, in the second embodiment, the plurality of terminal grooves 25 is provided and the plurality of terminals 41 is configured in the plurality of terminal grooves 25 and passing through the base 22, but embodiments are not limited thereto; in some implementation aspects, the insulation housing 21 and the plurality of terminals 41 are formed integrally as a whole. The method, such as insert molding, over molding, other molding techniques or the combinations thereof, can be used for forming the components integrally, which is not used to limit the present invention. In this case, the plurality of terminal grooves 25 is absent, and the plurality of terminals 41 is directly passing through the base 22. However, since the thermal expansion coefficients between the terminal 41 made of metal and the insulation housing 21 made of plastic are different, when the waterproof electronic receptacle connector 100 is heated during manufacturing processes, for example, during the tin furnace procedure, gaps are generated between the plurality of terminals 41 and the insulation housing 21, thereby providing insufficient waterproof performance. Therefore, the liquid sealing material 61 is applied in the gluing slot 27 firstly to undergo the drying process so as to be solidified, so that the sealing material 61 which is already solidified is formed in the gluing slot 27 and the plurality of extended recessions 271 to enclose the plurality of terminals 41. That is, the one faces of the plurality of terminals 41 are respectively abutted against the plurality of protruding blocks 26 and the other three faces of the plurality of terminals 41 are enclosed by the sealing material 61. Therefore, the gaps between the plurality of terminals 41 and the base 22 are filled with the sealing material 61.

In this disclosure, the waterproof ring gasket 51 is abutted between the base 22 and the inner wall of through hole 12 so as to prevent the moisture entering into the interior of the electronic device from the gaps between the outside of the base 22 and the inner wall of the through hole 12, wherein the waterproof electronic receptacle connector 100 is assembled to the electronic device. The sealing material 61, such as the waterproof adhesive bulk, is formed on the outer side plane 222 to fill in the gaps between the welding ends 412 and the plurality of terminals 41. Furthermore, even if the area of the sealing material 61 formed on the outer side plane 222 is smaller than the area of the outer side plane 222, the moisture is prevented from entering into the interior of the electronic device through the through hole 12. A relative less amount of sealing material 61 is applied to form on the outer side plane 222 as compared to conventional to provide the waterproof function; additionally, the drying time for solidifying the sealing material 61 is reduced. Alternatively, instead of forming on the outer side plane 222, the sealing material 61 is applied in the gluing slot 27 of the base 22 to fill the gaps between the plurality of terminals 41 and the base 22, thereby preventing the moisture from entering into the interior of the electronic device through the through hole 12.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A waterproof electronic receptacle connector, comprising:

a plastic-core housing, comprising a through hole;

an insulation housing, configured in the through hole, the insulation housing comprising:

a base, comprising an inner side plane and an outer side plane, the inner side plane facing toward the through hole, the outer side plane facing toward an outside of the through hole; and a tongue plate, extended from the inner side plane;

a plurality of terminals, passing through the base, each of the plurality of terminals comprising a contacting end and a welding end connected to the contacting end, the contacting end extended from the tongue plate, the welding end extruding from the outer side plane;

a waterproof ring gasket, abutted between the base and an inner wall of the through hole; and a sealing material, formed on the outer side plane to fill gaps between the plurality of terminals and the base.

2. The waterproof electronic receptacle connector according to claim 1, further comprising a plurality of terminal grooves, the plurality of terminals is configured in the plurality of terminal grooves respectively, the plurality of terminal grooves passes through the base to communicate with the inner side plane and the outer side plane.

3. The waterproof electronic receptacle connector according to claim 1, wherein the sealing material forms a waterproof adhesive bulk, the area of the waterproof adhesive bulk formed on the outer side plane is smaller than the area of the outer side plane.

4. The waterproof electronic receptacle connector according to claim 1, wherein the plastic-core housing comprises an abutting plane configured on the inner wall of the through hole to abut against the inner side plane.

5. The waterproof electronic receptacle connector according to claim 1, wherein the base comprises an indentation fitted with the waterproof ring gasket.

6. The waterproof electronic receptacle connector according to claim 1, wherein the plastic-core housing comprises a groove configured on the inner wall of the through hole to fit with the waterproof ring gasket.

7. The waterproof electronic receptacle connector according to claim 1, further comprising a casing enclosing the insulation housing and configured in the through hole.

8. A waterproof electronic receptacle connector, comprising:

a plastic-core housing, comprising a through hole;

an insulating base, configured in the through hole, the insulation housing comprising:

a base, comprising an inner side plane and an outer side plane, the inner side plane facing toward the through hole, the outer side plane facing toward an outside of the through hole;

a tongue plate, extended from the inner side plane;

a plurality of protruding blocks, configured on the base; and a gluing slot, configured on the base, the gluing slot comprising a plurality of extended recessions respectively corresponding to two sides of the plurality of protruding blocks;

a plurality of terminals, passing through the base, one faces of the plurality of terminals respectively abutted against the plurality of protruding blocks, each of the plurality of terminals comprising a contacting end and a welding end connected to the contacting end, the contacting end extended from the tongue plate, the welding end extruding from the outer side plane;

a waterproof ring gasket, abutted between the base and an inner wall of the through hole; and a sealing material, formed in the gluing slot and the plurality of extended recessions to enclose the plurality of terminals.

9. The waterproof electronic receptacle connector according to claim 8, further comprising a plurality of terminal grooves, the plurality of terminals is configured in the plurality of terminal grooves respectively, the plurality of terminal grooves passes through the base to communicate with the inner side plane and the outer side plane.

10. The waterproof electronic receptacle connector according to claim 8, wherein the plastic-core housing comprises an abutting plane configured on the inner wall of the through hole to abut against the inner side plane.

11. The waterproof electronic receptacle connector according to claim 8, wherein the base comprises an indentation fitted with the waterproof ring gasket.

12. The waterproof electronic receptacle connector according to claim 8, wherein the plastic-core housing comprises a groove configured on the inner wall of the through hole to fit with the waterproof ring gasket.

13. The waterproof electronic receptacle connector according to claim 8, further comprising a casing enclosing the insulation housing and configured in the through hole.

* * * * *